United States Patent [19]

Ginter et al.

[11] 4,185,128

[45] Jan. 22, 1980

[54] ANTI-SNAG FINISHING TREATMENT FOR FABRICS

[75] Inventors: Thomas O. Ginter, Sanford; James W. Lalk, Shepherd, both of Mich.

[73] Assignee: The Dow Chemical Company, Midland, Mich.

[21] Appl. No.: 573,484

[22] Filed: May 1, 1975

[51] Int. Cl.[2] ..... B05D 3/02

[52] U.S. Cl. ..... 427/390 R; 427/390 C; 427/390 E; 427/421

[58] Field of Search ..... 427/390 R, 390 E, 390 C, 427/421

[56] References Cited

U.S. PATENT DOCUMENTS

| | | | |
|---|---|---|---|
| 2,868,676 | 1/1959 | Ljungbo | 427/390 R |
| 2,949,386 | 8/1960 | Cassel | 427/390 R |
| 3,821,172 | 6/1974 | Sugiura et al. | 427/390 C |
| 3,852,102 | 12/1974 | Lalk et al. | 427/390 R |
| 3,900,663 | 8/1975 | Barabas et al. | 427/390 R |

*Primary Examiner*—Ronald H. Smith
*Assistant Examiner*—Janyce A. Bell

[57] ABSTRACT

A method for reducing the snagging of fabrics involves the application to the fabric of an emulsion of a chlorinated solvent as the continuous phase and as the dispersed phase, an aqueous latex of a polymer of from about 25 to 50 weight percent of a hydroxy lower alkyl acrylate, from about 6 to 12 weight percent acrylonitrile, from about 40 to 60 weight percent of a lower alkyl acrylate having from two to eight carbon atoms in the alkyl group and from about 1 to 5 weight percent acrylic acid wherein said polymer is of a high enough molecular weight to be insensitive to chlorinated solvents and water and after application and thereafter desolvating, dewatering and curing the polymer on the fabric.

11 Claims, No Drawings

ANTI-SNAG FINISHING TREATMENT FOR FABRICS

BACKGROUND OF THE INVENTION

The recent trend in garment fabrics from the traditional woven fabrics, such as worsted, to knit fabrics has created some serious manufacturing problems. For example, the present day mass production cutting techniques, as well as the new techniques, e.g., laser, available to the men's garment industry have been found substantially unusable. Previously, a manufacturer could cut many layers of fabric when employing such fabrics as the worsted. However, when knits began to be employed, because of sagging, stretching, etc., only a few layers of the fabric could be cut at one time. Knit fabrics normally require up to 24 hours to relax on the cutting table before they can be cut. This is to insure the fabric has returned to its original dimensions after being stretched as it was laid upon the cutting table. Knit fabrics generally require more time and care in handling resulting in fewer garments being constructed per hour of work.

The same problems as well as others carry over to the finished garment. One of the chief deterrents to the growth of double-, single- and warp knit garments is their tendency to snag. That tendency is particularly troublesome with lighter weight fabrics as are used in wearing apparel. Snagging is enough of a problem to overshadow all of the comfort features of such garments. Thus, the need for a treatment for fabrics to eliminate or at least to minimize snagging is a priority objective of the garment industry. Such a treatment should be permanent to survive dry cleaning and/or machine washing. It should not alter the hand or other desirable characteristics of the fabric. It should be easily and economically applied. Other suitable attributes will be recognized by the industry.

Techniques and compositions are known for overcoming or minimizing those problems. However, those systems require special equipment designed for the treatment. Many fabric processors have continuous solvent finishing equipment on hand. It would be desirable to develop a system that would be compatible with that equipment.

The Prior Art

In U.S. Pat. No. 3,852,102 there is described an anti-snag treatment for fabrics involving the application of an aqueous latex of a polymer on the fabric.

SUMMARY OF THE INVENTION

This invention is a method for upgrading woven or knit textile fabrics. The method comprises the application to the fabric of an emulsion of a chlorinated solvent as the continuous phase and an aqueous latex of a particular class of polymers as the dispersed phase, followed by desolvating, dewatering the coating and curing the so applied polymer. The method is especially adapted for use with conventional solvent finishing equipment for fabrics.

The chlorinated solvent will be selected from those utilized in the dry cleaning industry and will include specifically 1,1,1-trichloroethane. Other chlorinated solvents such as the chlorinated derivatives of methane would be operable but generally unacceptable for other reasons.

The polymer of the aqueous latex will be composed of from about 25 to 50 weight percent of a hydroxy lower alkyl acrylate, from about 40 to 60 weight percent of a lower alkyl acrylate having from two to eight carbon atoms in the alkyl group and from about 1 to 5 weight percent acrylic acid wherein the polymer is above a stated minimum molecular weight.

The indicated polymer represents a balance of monomeric moieties that provides a broad spectrum of advantages to the polymer and thus to the treated fabric.

The hydroxy lower alkyl acrylate contains from two to four carbon atoms in the alkyl group and is present in amount of from about 25 to 50 weight percent of the polymer composition. When lesser amounts than 25 percent are used the resulting polymer is solvent sensitive, unduly harsh, has reduced elongation and toughness. Over 50 percent results in a water sensitive polymer.

If more than the stated amount of acrylonitrile is employed the interpolymer is stiff and hard and is not suitable for application to fabrics. Less than 6 percent acrylonitrile provides a polymer that is dry cleaning solvent (chlorinated solvents) sensitive.

The lower alkyl acrylate should have from two to eight carbon atoms in the alkyl group and be present in amount of from about 40 to 60 weight percent of the polymer composition. Less than the indicated amount will give a hard polymer having water sensitivity. When the polymer contains more than 60 percent of the acrylate it is solvent sensitive and has reduced toughness.

The acrylic acid is present to provide a latent acidic function for potential crosslinking and to provide a polymerization control. If more than 5 percent acrylic acid is used the latex has reduced shelf stability and the polymer is water sensitive and hard. If less than 1 percent is employed the latex is unstable and the polymer is solvent sensitive and lacks durability.

In addition to the balance of monomers the polymer should be of a molecular weight high enough to be insensitive to chlorinated solvents. If the molecular weight is significantly lower, an unacceptably high concentration of a crosslinking agent is required to confer dry cleaning permanence to the treated fabric. By insensitive is meant that the properties of a film made from the polymer are not significantly changed upon exposure to chlorinated solvents or water.

The polymer latexes are made by conventional emulsion polymerization technology using known emulsifiers and catalysts and known ranges of the parameters of temperature, pressure and solids.

Although most of the benefits of the invention are achieved by use of the unmodified latex, it may be desirable to add certain functional ingredients thereto for special effects or to tailor the coating for a particular family of properties. For example, dry cleaning permanence is imparted by use of a polyfunctional compound reactive with the carboxylic or hydroxyl moieties. Thus, a small amount of from about 2 to 5 weight percent based on the polymer of a melamine resin will improve those named properties without undesirable effect on the hand of the treated fabrics. Other useful polyfunctional agents will be known. The crosslinking reaction may be accomplished by exposure to elevated temperature of for example from 240° to 260° F. or by use of an acidic catalyst.

The use of the emulsion polymerizate of the indicated monomers creates a relatively high molecular weight polymer which, when deposited on the fabric, lends permanence to the finish especially to subsequent laundering and dry cleaning.

The emulsion is prepared by known procedures. Most conveniently the latex is gradually added to the stirred solvent.

The emulsion of latex in chlorinated solvent is generally of limited stability and will exhibit phase separation in a relatively short time. The stability is usually adequate if prepared immediately prior to application on the fabric. If the emulsion is to be transferred or stored prior to such application, it is necessary to increase the stability by incorporation of an emulsion stabilizing wetting agent. Such wetting agents are known for water in oil emulsions. Typical examples include dioctyl ester of sulfosuccinic acid and N-cetyl-N-ethyl morpholinium ethosulfate. Others will be known from reference to lists of such agents.

The proportions of the ingredients may be varied within relatively wide limits. Most effective results are obtained when the polymer composition is added to the fabric in the range of about 1 to 5 weight percent. Within the range the treatment does not significantly affect the esthetic characteristics or the hand of the fabric and does achieve the objectives of the invention. The ingredients of the emulsion are chosen to provide the amount of fabric add-on most efficiently. This is achieved when the polymer is present in the emulsion in the range of about 0.5 to 15 weight percent based on the total composition. The emulsifier will be in the range of about 0 to 15 weight percent on the same basis. Preferably, the emulsifier will be in the range of 1 to 8 weight percent. Within those requirements the ratio of water to chlorinated solvent will depend on the solids content of the latex. As a general guide the amount of water in the emulsion should be kept at a minimum so that the drying character of the applied coating will be that of the solvent. That minimum is most easily achieved by using the latex at the highest level of solids at which the latex will be stable to the shearing forces generated in preparing the water in oil emulsion. Thus, latexes having between from about 30 to 50 weight percent solids are preferred. Latexes with lower polymer solids may be employed but with longer drying times on the fabric and with a more difficult separation of water and solvent when it is desired to recycle the solvent.

The composition can be applied by known means employed in the textile industry. Preferably, the treatment is applied to the goods by spray application. Spraying results in a fabric of better hand than that resulting from application of the same composition by padding or other conventional technique. The treatment may be applied after dyeing and scouring and before heat setting or to the finished fabric or even to the finished garment. It is an advantage that when the composition is applied before heat setting, the subsequent exposure to elevated temperature to set the fabric will also cure the polymer.

The invention is illustrated by the following examples wherein all parts and percentages are by weight.

EXAMPLE 1

A stable emulsion was formed from 89.86 percent 1,1,1-trichloroethane; 9.8 percent of an aqueous latex containing 30 percent solids of a polymer of 43 percent hydroxypropyl acrylate, 9 percent acrylonitrile, 46 percent butyl acrylate and 2 percent acrylic acid ammonium salt and containing 5 percent of a water soluble melamine resin sold commercially as MM83 by the Rohm and Haas Company; and 0.296 percent of an alkyl benzene sulfonate organic salt sold commercially as Ultrawet L-60 by the Arco Chemical Company. The emulsion was prepared by vigorously agitating the chlorinated solvent and slowly adding thereto the latex and surfactant. That resulted in an emulsion containing 2.79 percent polymer,, 0.178 percent melamine resin, and 6.86 percent water.

The emulsion was applied to a 10 ounce green rib double knit polyester fabric with an air pressurized spray gun. The fabric was dried in a hot air oven at 150° C. for 2 minutes to give an add-on of 1.5 percent.

The fabrics were tested for snagging with an ICI Mace Snagger. In that test a sleeve of the fabric is slipped over a cylinder which is rotated counterclockwise for 600 revolutions with a spiked spherical mace bouncing against the fabric. The fabric is then compared against rating standards and rated from 1 being the largest number of snags to 5 with no snags.

The mace snag evaluation was performed on an untreated swatch 5 of fabric and on the treated fabric as prepared and after detergent wash cycles and 4 dry cleaning cycles. The results are shown in the following table.

| Sample | As Prepared | After 5 Wash Cycles | After 4 Dry Cleaning Cycles |
|---|---|---|---|
| Control | 3.5 | 3.0 | 2.0 |
| Treated | 4.7 | 4.7 | 4.0 |

EXAMPLE 2

Example 1 was repeated using perchloroethylene CS as the chlorinated solvent and the dioctyl ester of sodium sulfosuccinic acid as the surfactant.

The emulsion was applied to a 10½ ounce red twill fabric to obtain a polymer add-on of 1.5 percent. The fabric was dried at 150° C. for two minutes.

The mace snag evaluation was performed as in the preceding example with the following results:

| Sample | As Prepared | After 5 Wash Cycles | After 4 Dry Cleaning Cycles |
|---|---|---|---|
| Control | 4.9 | 4.8 | 2.0 |
| Treated | 5.0 | 5.0 | 4.0 |

What is claimed is:

1. A method for reducing the snagging of fabrics comprising the application to the fabric of an emulsion of a chlorinated solvent as the continuous phase and as the dispersed phase, an aqueous latex of a polymer comprising from about 25 to 50 weight percent of a hydroxy ower alkyl acrylate, from about 6 to 12 weight percent acrylonitrile, from about 40 to 60 weight percent of a lower alkyl acrylate having from two to eight carbon atoms in the alkyl group and from about 1 to 5 weight percent acrylic acid wherein said polymer is of a molecular weight sufficiently high enough to be insensitive to chlorinated solvents and water, followed by desolvating and dewatering the coating and curing the polymer.

2. The method of claim 1 wherein said emulsion is applied to the fabric in an amount to provide between about 1 to 5 weight percent polymer add-on to the fabric.

3. The method of claim 1 wherein said chlorinated solvent is 1,1,1-trichloroethane.

4. The method of claim 1 wherein said hydroxy lower alkyl acrylate is hydroxypropyl acrylate.

5. The method of claim 1 wherein said alkyl acrylate is butyl acrylate.

6. The method of claim 1 wherein said emulsion contains up to 15 weight percent of an emulsion stabilizing wetting agent.

7. The method of claim 6 wherein said wetting agent is the dioctyl ester of sodium sulfosuccinic acid.

8. The method of claim 1 wherein said fabric is a knit fabric.

9. The method of claim 1 wherein said emulsion is applied to the fabric by spray application.

10. The method of claim 1 wherein said dispersed phase comprises said latex of said polymer and a polyfunctional organic compound reactive with the carboxyl or hydroxyl groups of said polymer.

11. The method of claim 10 wherein said polyfunctional organic compound is a water soluble melamine resin.

* * * * *

UNITED STATES PATENT AND TRADEMARK OFFICE

CERTIFICATE OF CORRECTION

PATENT NO. : 4,185,128

DATED : January 22, 1980

INVENTOR(S) : Thomas O. Ginter; James W. Lalk

It is certified that error appears in the above-identified patent and that said Letters Patent are hereby corrected as shown below:

Col. 3, line 23, delete "the" (first occurrence) and insert --that--.

Col. 3, line 27, delete "the" and insert --that--.

Col. 4, line 8, after "polymer" delete ",," and insert --,--.

Col. 4, line 22, delete "5".

Col. 4, line 23, after "after" insert --5--.

Col. 4, line 59, delete "ower" and insert --lower--.

Signed and Sealed this

*Third* Day of *June 1980*

[SEAL]

*Attest:*

SIDNEY A. DIAMOND

*Attesting Officer*

*Commissioner of Patents and Trademarks*